US006241106B1

(12) United States Patent
Fujita et al.

(10) Patent No.: US 6,241,106 B1
(45) Date of Patent: Jun. 5, 2001

(54) MOVABLE SHELF

(75) Inventors: Tsunehiko Fujita, Atsugi; Tadaaki Takenaka, Osaka, both of (JP)

(73) Assignee: Erecta International Corporation, Tokyo (JP)

( * ) Notice: Subject to any disclaimer, the term of this patent is extended or adjusted under 35 U.S.C. 154(b) by 0 days.

(21) Appl. No.: 09/294,287

(22) Filed: Apr. 19, 1999

(51) Int. Cl.[7] ..... A47F 5/00
(52) U.S. Cl. ..... 211/134; 211/94.02; 211/162
(58) Field of Search ..... 211/94.01, 94.02, 211/134, 151, 162, 175, 187, 189; 312/201

(56) References Cited

U.S. PATENT DOCUMENTS 3,570,683 * 3/1971 Dickgeisser ..... 211/162
3,658,186 * 4/1972 Lodige ..... 211/134
3,762,335 * 10/1973 Baker, Jr. et al. ..... 104/173
3,801,176 * 4/1974 Higbee ..... 312/199
4,991,725 * 2/1991 Welsch et al. ..... 211/162
5,072,838 * 12/1991 Price, Jr. et al. ..... 211/162
5,226,549 * 7/1993 Price, Jr. et al. ..... 211/162
5,285,910 * 2/1994 Chen ..... 211/162
5,624,166 * 4/1997 Theken et al. ..... 211/162 X

* cited by examiner

*Primary Examiner*—Daniel P. Stodola
(74) *Attorney, Agent, or Firm*—Pitney, Hardin, Kipp & Szuch, LLP

(57) ABSTRACT

A moving shelf assembly having moving shelf main bodies capable of moving by wheels attached to the lower portion and whose motion is guided by rails built on the top portion, stopper parts capable of moving up and down attached to the moving shelf main bodies, and height adjusting parts which adjust the height at which the stopper parts are attached in relation to the moving shelf main bodies, and wherein plugs capable of being inserted into and pulled out of guiding grooves open on the lower surface of the rails protrude upwards from the stopper parts, and the height at which the stopper part is attached in relation to the moving shelf main body is adjusted by the height adjusting part, and wherein the moving shelf main body is separated from the rails when the plugs, which are inserted in the guiding grooves, are pulled out of the guiding grooves and is then capable of moving freely by the wheels.

3 Claims, 8 Drawing Sheets

(PRIOR ART)

(PRIOR ART)

MOVABLE SHELF

BACKGROUND OF THE INVENTION

1. Field of the Invention

The present invention relates to a moving shelf assembly, having moving shelf main bodies capable of moving by means of wheels attached to the lower portion whose motion is guided by rails built on the upper portion. Furthermore, the present application is based on the contents of Japanese Patent Application No. Hei 9-182875, the contents of which are incorporated hereinto by reference.

2. Description of the Related Art

FIG. 7 is a perspective view of an example of a conventional moving shelf assembly. Reference 1 is the moving shelf main body, 2*a* and 2*b* are rails, and 3 are stopper shelves.

Moving shelf main body 1 is assembled by means of four poles 4 extending vertically providing multiple support for a plurality of shelving 5 arranged therebetween, and is made capable of moving by wheels 6 attached to the lower edges of poles 4. Four plugs 7 are formed by vertically extending the upper portions of poles 4 from the upper portion of moving shelf main body 1. A pair of rails 2*a* and 2*b* are horizontally installed on the lower surface of the ceiling of the building or in the neighborhood of the ceiling, and guiding grooves 8 are open on the lower surfaces of rails 2*a* and 2*b*. The above-mentioned plugs 7 are respectively inserted in guiding grooves 8, and as a result moving shelf main body 1 is made capable of moving horizontally, travelling on floor 9 along the above-mentioned rails 2*a* and 2*b*. Stopper shelves 3, which prevent moving shelf main body 1 from breaking out of the established movement range 10, are disposed at both ends in the longitudinal direction of rails 2*a* and 2*b*.

In addition, as indicated in FIG. 8, spacers 11 are attached to the upper ends of plugs 7, and by means of the contact between the spacers 11 and the inner surface of guiding grooves 8, moving shelf main body 1 is stabilized and moves along guiding grooves 8 without shaking.

Generally, in this type of moving shelf, a plurality of moving shelf main bodies 1 are disposed within scope of movement 10 as shown in FIG. 7. Consequently, when taking items in and out, the troublesome operation of moving a plurality of moving shelf main bodies 1 within the scope of movement 10 in order to assure workspace around the periphery of the targeted moving shelf main body 1 is necessary. In particular, in cases where a conveyor wagon is employed for taking items in out, it is preferable for the conveyor wagon to be brought into scope of movement 10 from path 12 close to moving shelf main body 1 in order to improve the working properties. However, to ensure space around the periphery of the targeted moving shelf main body 1 for the conveyor wagon to enter, the necessity arises for large movements of the plurality of moving shelf main bodies 1, which creates further troublesome operations.

SUMMARY OF THE INVENTION

The moving shelf assembly of the present invention comprises moving shelf main bodies capable of moving by means of wheels attached to the lower portion and whose motion is guided by rails built on the top portion, stopper parts capable of moving up and down attached to the top of the above-mentioned moving shelf main bodies, and height adjusting parts for adjusting the height at which the stopper parts are attached in relation to the moving shelf main bodies, and wherein plugs capable of being removably inserted into guiding grooves which are open on the lower surface of the above-mentioned rails protrude upwards from the above-mentioned stopper parts, and by means of adjusting the height at which the above-mentioned stopper parts are attached in relation to the above-mentioned moving shelf main bodies using the above-mentioned height adjusting part, the plugs are inserted into or pulled out of the above-mentioned guiding grooves when the plugs are pulled out of the above-mentioned guiding grooves, the moving shelf main body can be separated from the rails and can move freely on the wheels.

Here, it is preferable that the height adjusting part is attached in a freely rotating manner to the stopper part, and a handle is made which is operated by manual rotation from the outside of the moving shelf main body, and a plurality of engaging parts, engaged to and capable of being disengaged from the stopping parts formed on the moving shelf main body, are formed at varying intervals from the center of rotation of the handle. In this case, the height of the stopper part is adjusted by engaging and disengaging the engaging part from the stopper part.

In addition, it is more preferable that the above-mentioned moving shelf bodies are comprised of a plurality of poles, each extending vertically and separated from each other, and one or more shelves supported between the above-mentioned poles, and a shelf positioned on the upper portion of the above-mentioned moving shelf main body is used as the above-mentioned stopping part.

DESCRIPTION OF THE EMBODIMENTS

A preferred embodiment of the moving shelf assembly of the present invention is explained below with reference to FIGS. 1~4. Furthermore, within the following description, parts having structures identical to the above-mentioned FIGS. 7 and 8 will be affixed with the same reference number and the explanations of the above-mentioned parts will be omitted.

Figure 1:
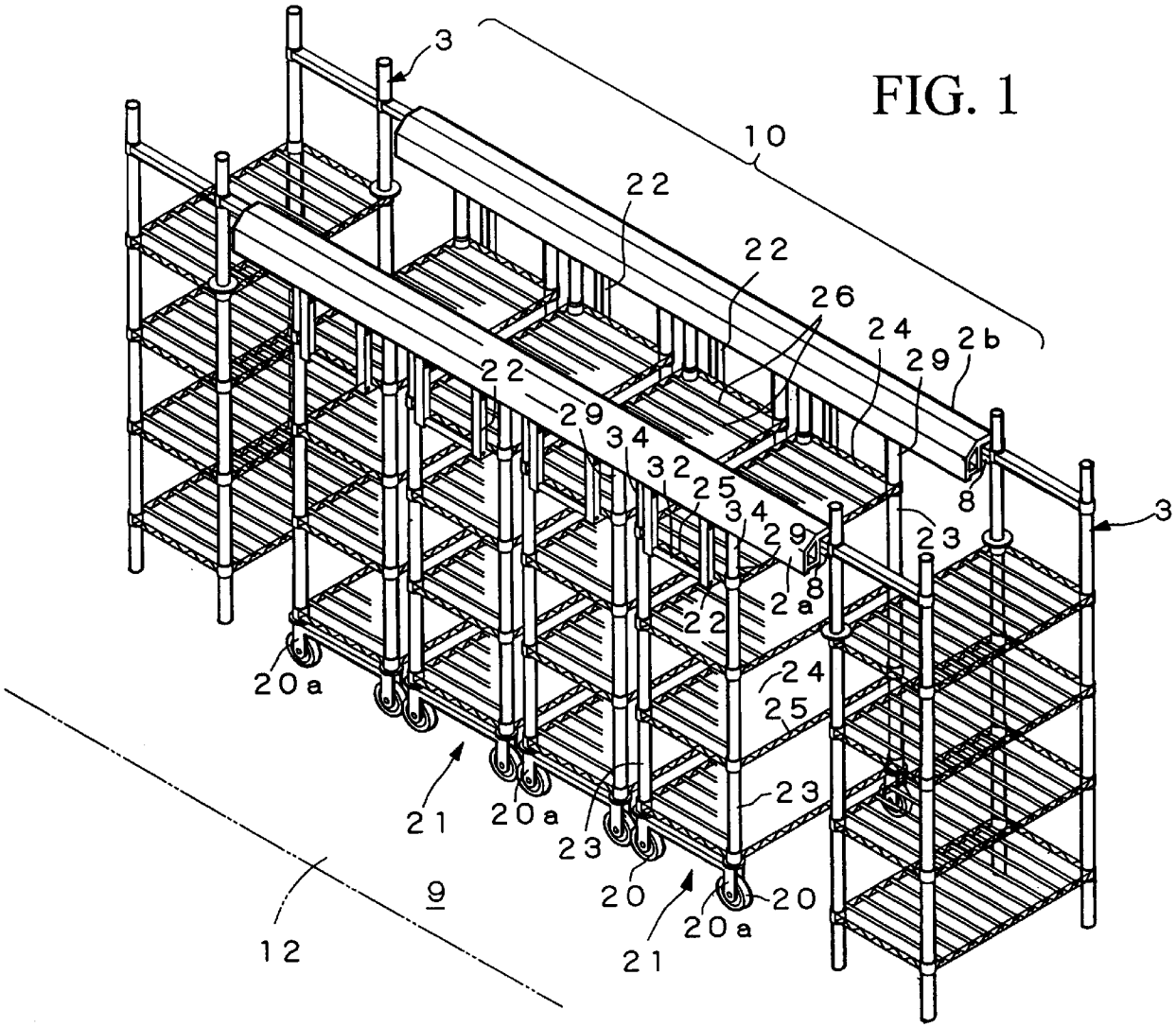
FIG. 1 is a perspective drawing showing a preferred embodiment of the moving shelf assembly of the present invention.

FIG. 1 is a perspective view showing the moving shelf assembly of the present invention. The moving shelf assembly comprises moving shelf main bodies 21 capable of moving by means of wheels 20 attached to the lower portion and whose motion is guided by rails 2*a* and 2*b* built on the top portion, and stopper parts 22 capable of moving up and down attached to the upper portion of moving shelf main body 21.

Figure 7:
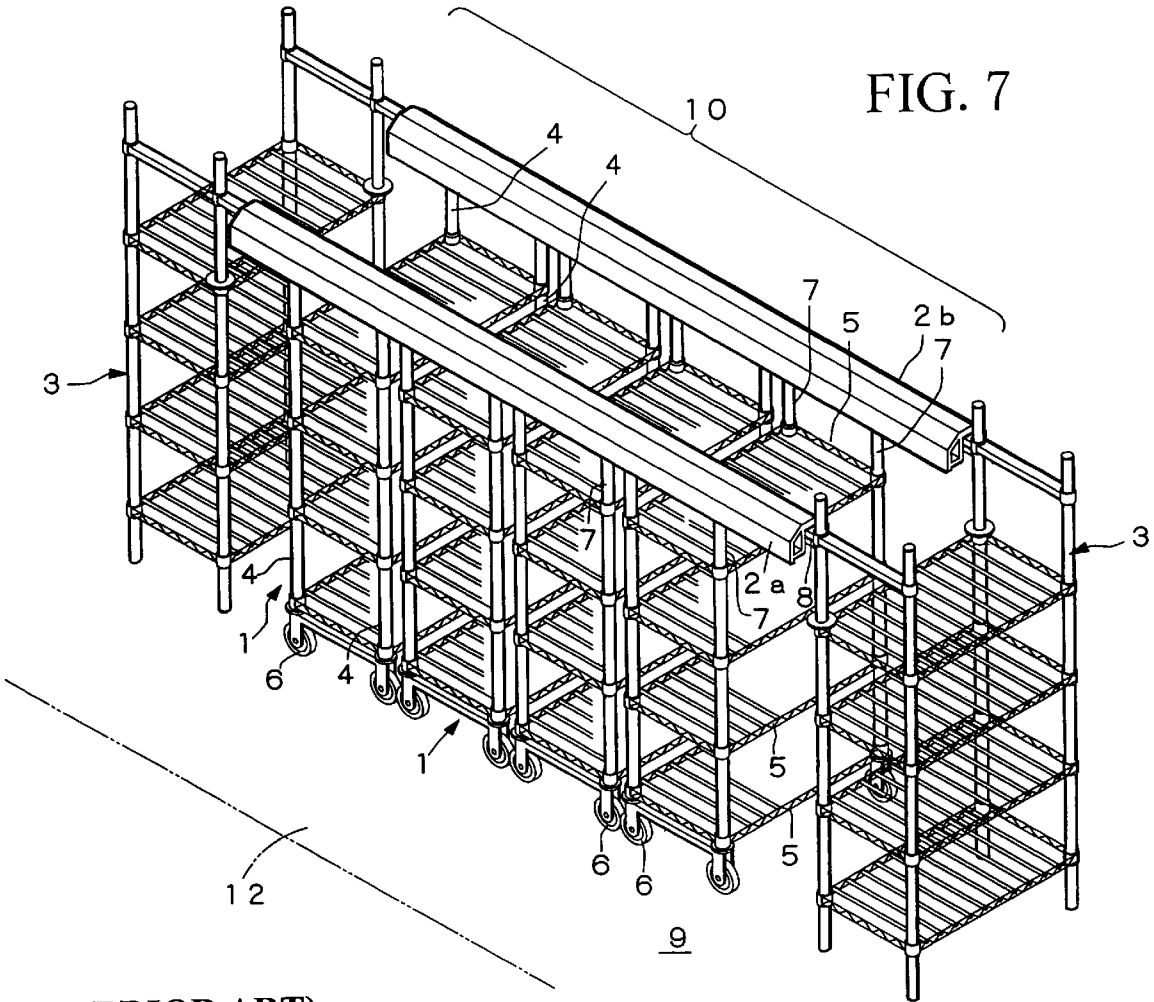
FIG. 7 is a perspective view showing an example of a conventional moving shelf assembly.
Figure 8:
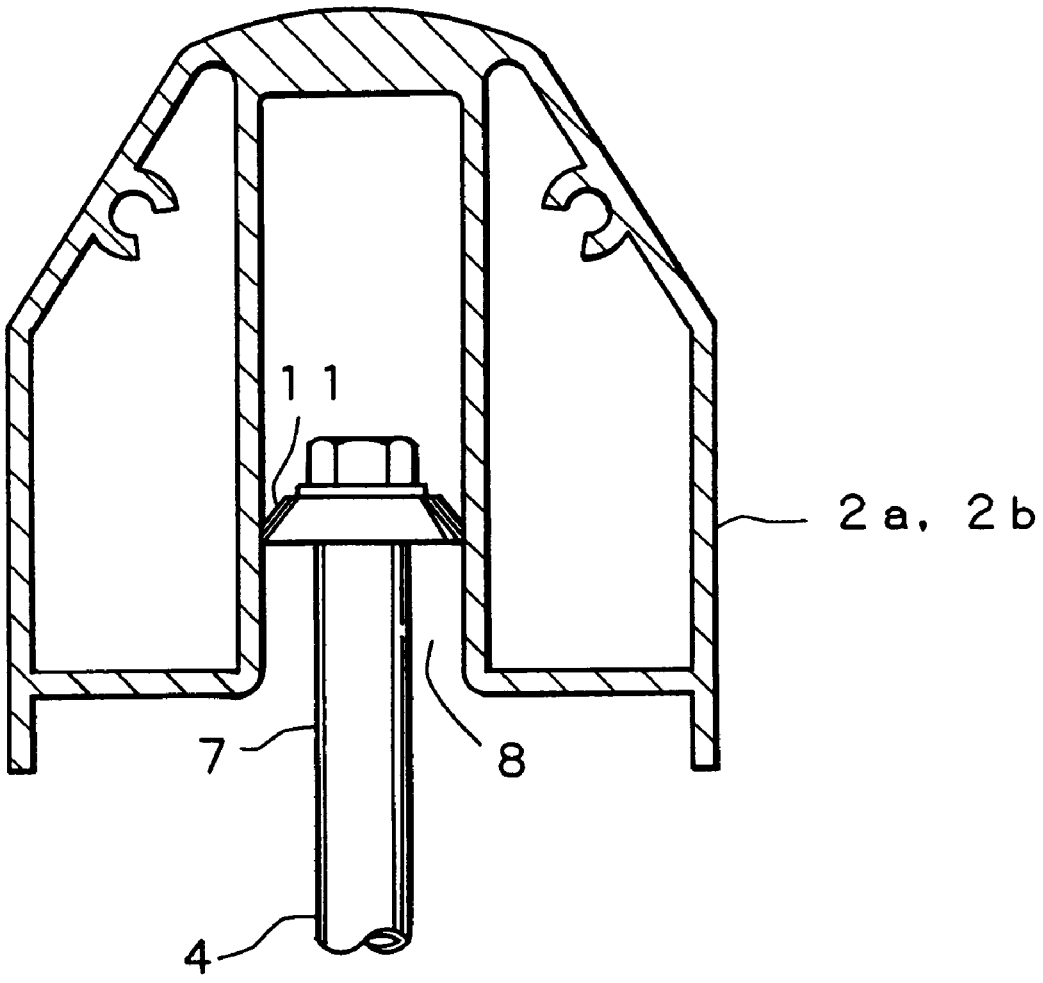
FIG. 8 is a cross-sectional view indicating the state in which the plug is inserted in the guiding grooves of the moving shelf assembly in FIG. 7.

Moving shelf main body 21, in the same manner as moving shelf main body 1 indicated in FIG. 7, is assembled by a plurality of shelving 24 multiply supported between four poles 23 which extend vertically. Poles 23 are of a hollow pipe shape comprised of materials having sufficient rigidity such as steel pipes and the like, and wheels 20 are mounted capable of freely changing the direction of movement via bracket 20*a* which is capable of rotating around the axis of pole 23 on the lower edge thereof. In addition to wheels 20, it is preferable for a stopper to be attached which controls/ releases control of the rotation thereof.

Figure 2:
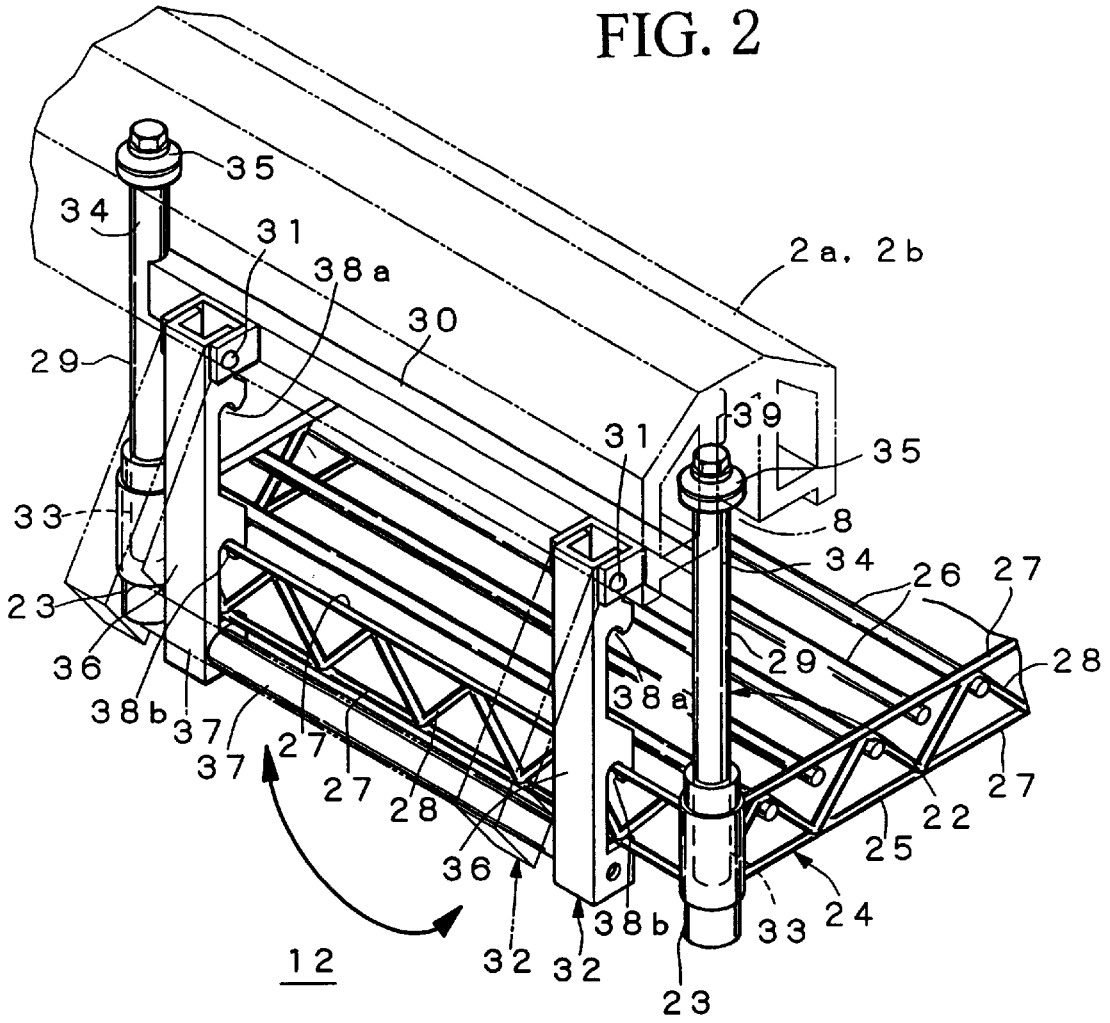
FIG. 2 is a perspective view showing the structure of the stopper part of the moving shelf assembly in FIG. 1.

Shelving 24, as indicated in FIG. 2, is formed by fixing by means of welding or the like a plurality of wires 26 formed in a rod shape to the inside of outer frame 25 formed in a rectangular shape, and has sufficient rigidity. In addition, outer frame 25 is also formed by fixing by means of welding or the like corrugated wire 28 between two outer frame wires 27 formed in a rod shape and positioned parallel to and separated from each other, in the direction of the thickness of the shelving 24 (the vertical direction in FIG. 1). Consequently, shelving 24 as a whole has high resistance to deformation in every direction.

Stopper part 22, as indicated in FIG. 2, is, as a whole, an H-shaped member comprising, in outline, a pair of insertion frames 29 positioned along rail 2*a* parallel to and separated from each other, and communication frame 30 which connects these insertion frames 29, and is positioned, respectively, facing the side part of route 12 of moving shelf main body 21 and facing the side part of the opposite side of route 12.

The lower edge parts 33 of the above-mentioned pair of insertion frames 29 are inserted capable of moving up and down into poles 23 of moving shelf main body 21, and plugs 34 formed on the upper portions of insertion frames 29 removably inserted into the guiding grooves 8 of rail 2*a*. In addition, spacers 35 are attached to the upper ends of plugs 34. Spacers 35 come into contact with the inner surface of guiding grooves 8, preventing drifting and clattering when plugs 34 move along guiding grooves 8.

Hinges 31 are respectively attached to the side surface of communication frame 30 facing the outside of moving shelf main body 21, and height adjusting part 32 (handle) which has an angular u-shape, is attached capable of rotating around each hinge 31 as the fulcrum at the outside of moving shelf main body 21. Height adjusting part 32 is made such that it is possible to be easily manually operated by the operator from the outside of moving shelf main body 21.

Height adjusting part 32 is formed by a pair of links 36 having a square column shape attached to communication frame 30 through hinges 31 and handle part 37 which connects the other ends, away from the hinges 31, of each of theses links 36. Engaging parts 38*a* and 38*b* (concave places) engaged to and capable of being disengaged from above to outer frame 25 of the highest level shelf 24 (stopping part) of moving shelf main body 21 are formed at intervals along the longitudinal direction of link 36 on the side of communication frame 30 of link 36. Since engaging parts 38*a* and 38*b* are formed to engage, from above outer frame wire 27 of the upper portion of outside frame 25, when stopper part 22 is raised, the above-mentioned engaging parts are easily separated from outer frame wire 27.

As mentioned above, since engaging parts 38*a* and 38*b* are formed to engage with outside frame 25 of shelving 24, it is not necessary to provide additional stopping parts to moving shelf main body 21, which reduces the number of parts and contributes to the acquired effects of lowering the costs and size of moving shelf main body 21. On the other hand, in cases where shelving 24 is not in an appropriate location on moving shelf main body 21, additional stopping parts can be attached to moving shelf main body 21.

Figure 5:
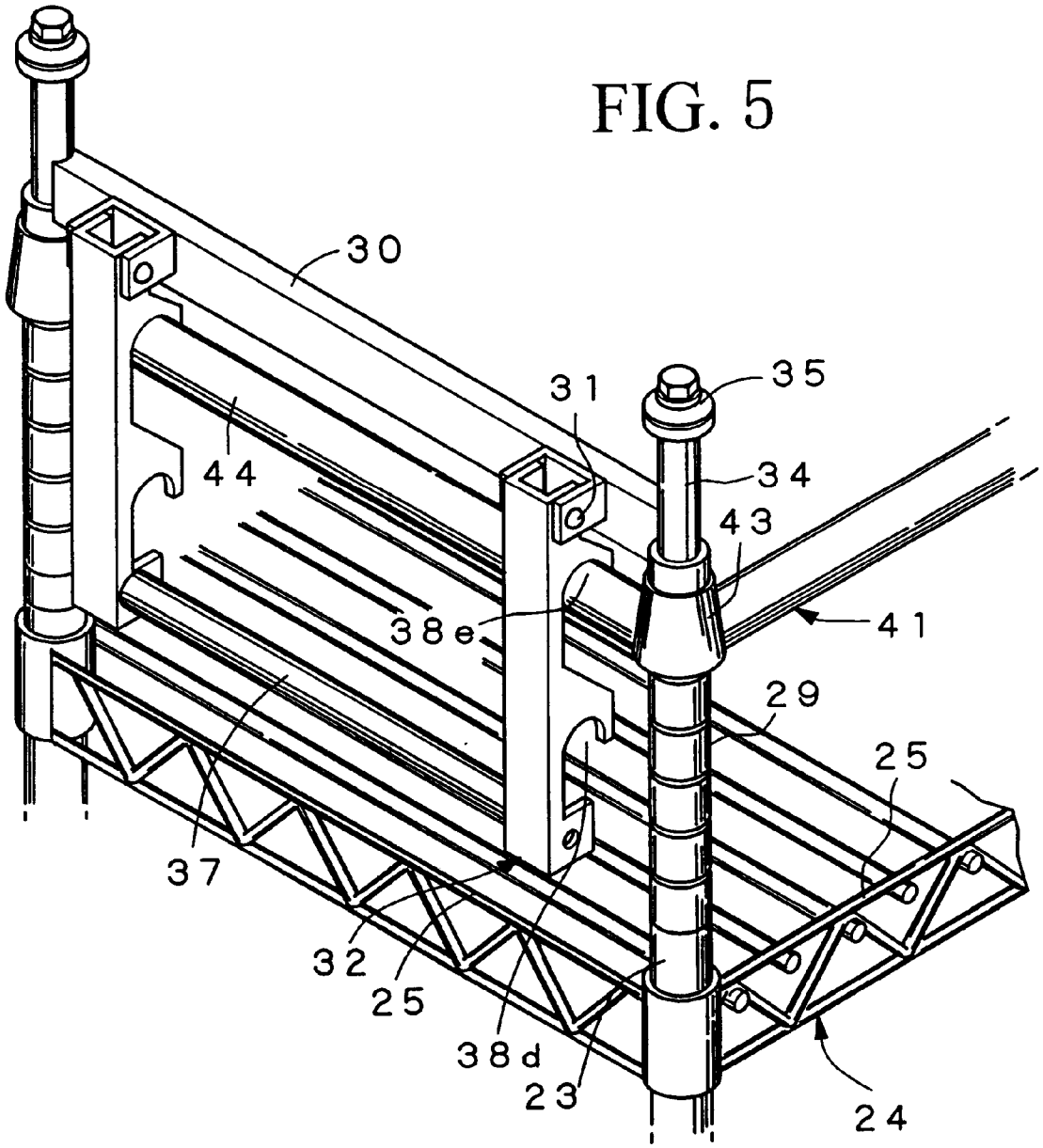
FIG. 5 is a perspective view indicating an example of an auxiliary attachment used on the moving shelf assembly of the present invention.
Figure 6:
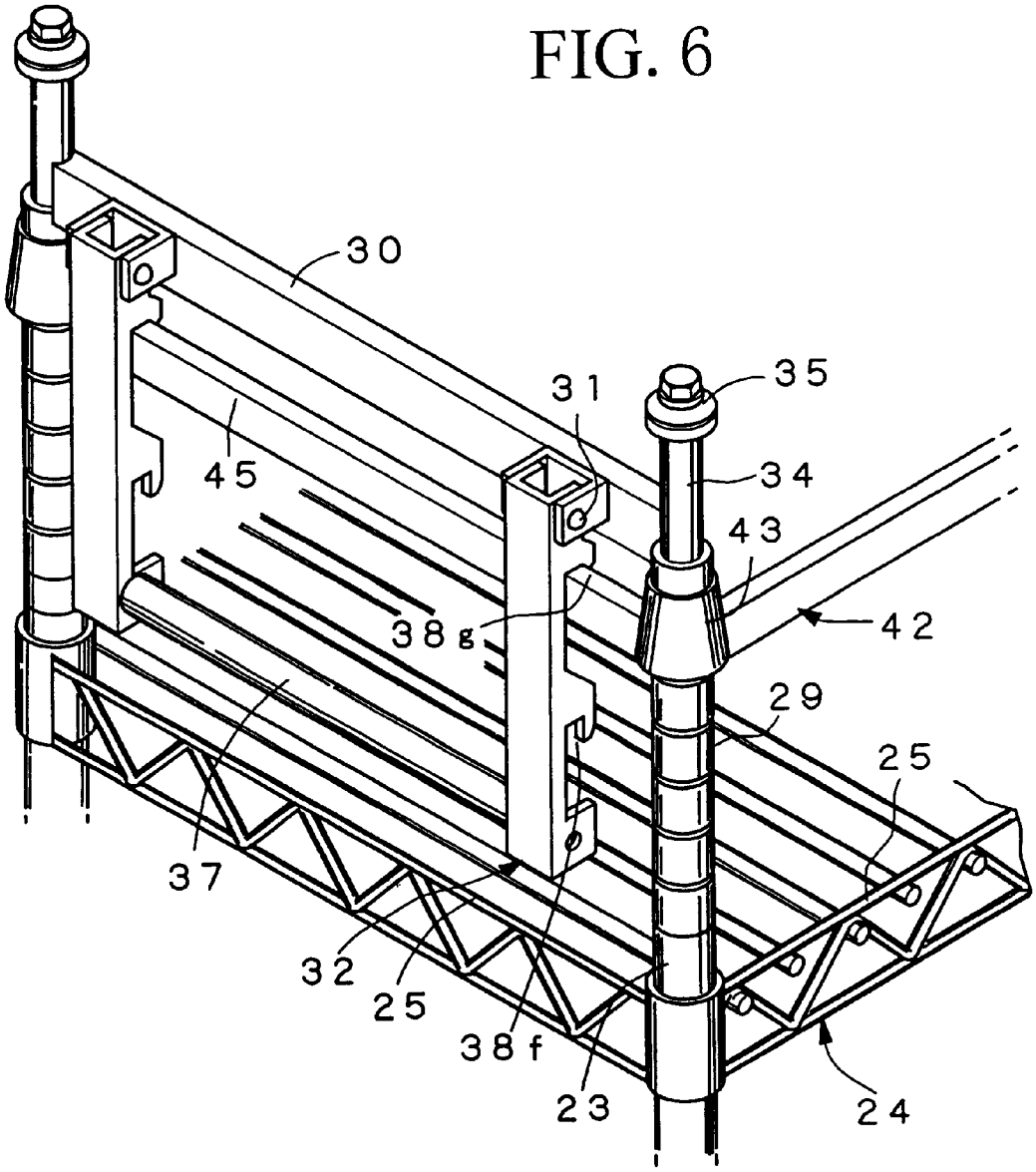
FIG. 6 is a perspective view indicating another example of an auxiliary attachment used on the moving shelf assembly of the present invention.

Auxiliary attachments 41 and 42 attached to the upper portion of moving shelf main body 21 are shown in FIGS. 5 and 6. Auxiliary attachment 41 shown in FIG. 5 is attached by inserting fitting 43 on the upper end of pole 23. This auxiliary attachment 41 comprises a rod shaped stopping part 44 which is circular in cross-section arranged between poles 23, and semi-circular shaped engaging parts 38*d* and 38*e* formed on link 36 of height adjusting part 32 are stopped in a disengagable manner on the above-mentioned stopping part 44. Since the above-mentioned auxiliary attachment 41 is made such that engaging parts 38*d* and 38*e* having curved surfaces can be engaged with and disengaged from stopping part 44 having a corresponding curved surface, it is possible to carry out the engaging and disengaging operations smoothly.

Other than that it is equipped with stopping part 45 which is rectangular in cross section longitudinal shape, the structure of auxiliary attachment 42 shown in FIG. 6 is the same as that of auxiliary attachment 41. Engaging parts 38*f* and 38*g* of having an angular hole shape formed on link 36 of height adjusting part 32 are engaged in a disengagable manner on this stopping part 45. In this auxiliary attachment 42, since it is difficult to release the condition of engaging even under the influence of vibration from the movement and the like of moving shelf main body 21, the engaged condition can be reliably maintained.

Furthermore, it is preferable for the above-mentioned auxiliary attachments 41 and 42 to be detachable from moving shelf main body 21.

Next, the operation of the moving shelf assembly is explained.

As indicated in FIG. 2, in the condition in which engaging part 38*b* located on the side of handle 37 of height adjusting part 32 is engaged to outside frame 25 of the highest level of shelving 24 of moving shelf main body 21, the lowering of stopper part 22 is controlled by means of the engagement of engaging part 38*b* and outside frame 25, and the condition of plugs 34 inserted in guiding grooves 8 is maintained. In this situation, as shown in FIG. 1, moving shelf main body 21, in the same manner as the conventional moving shelf main body 1, moves only within the scope of movement 10 provided between stopper shelves 3.

Figure 3:
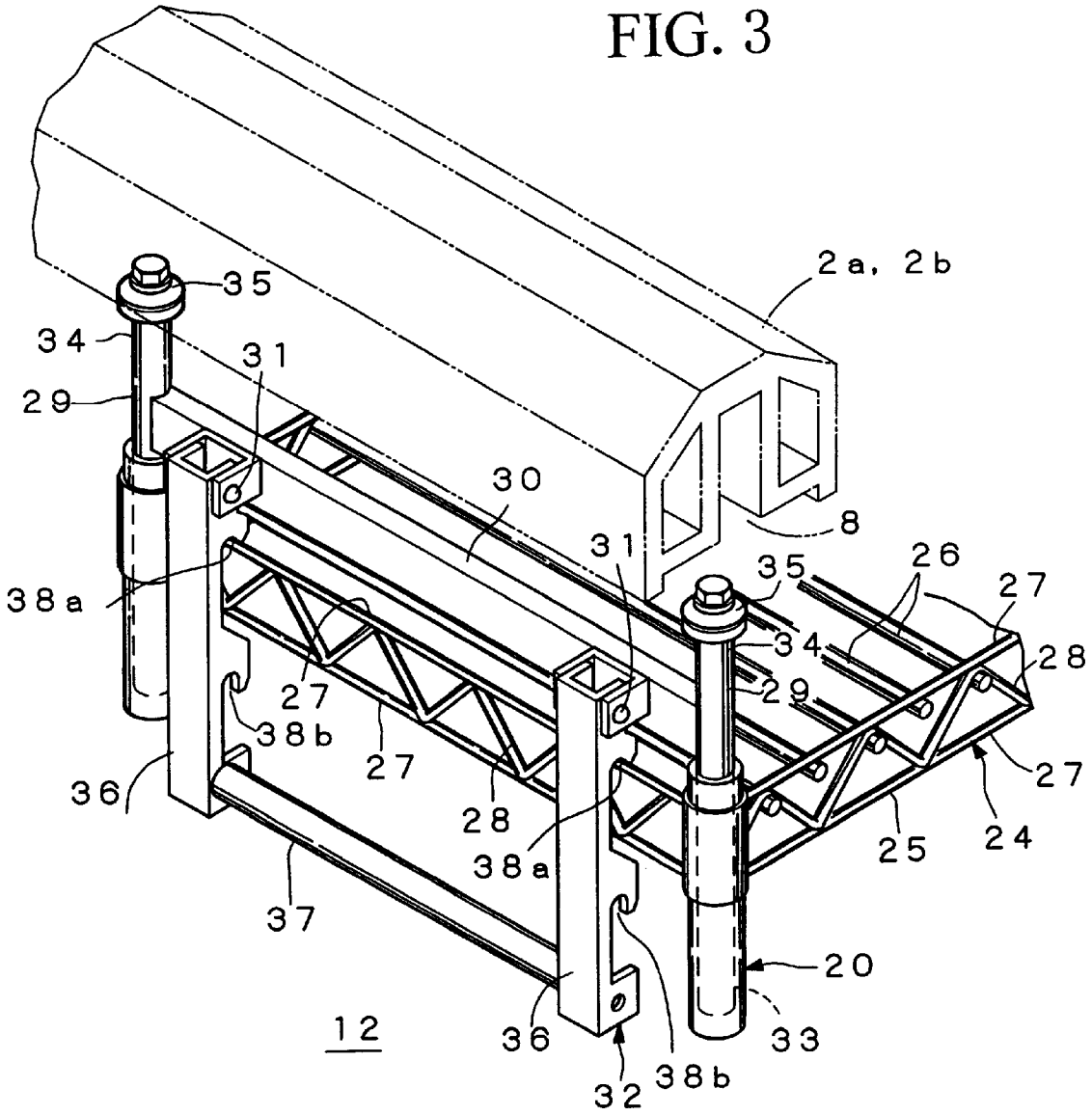
FIG. 3 is a perspective view of indicating the operation of the moving shelf assembly in FIG. 1 and indicating the state in which the stopper part is turned down.

The operator operates stopper parts 22 located on both sides of moving shelf main body 21 and height adjusting part 32, releasing the engagement between engaging part 38*b* and outside frame 25, and engaging engaging parts 38*a*, located on the hinge 31 side to outside frame 25. Furthermore, as shown in FIG. 3, stopper parts 22 are supported in a position lower than that indicated in FIG. 2, and plugs 34 of stopper parts 22 is pulled downwards and out of guiding groove 8.

In the case of this operation, firstly, stopper part 22 or height adjusting part 32 is lifted, stopper part 22 is raised slightly within the scope of interval 39 (refer to FIG. 2), which protects plug 34 in the upper direction within guiding grooves 8, and engaging part 38*b* separates from outside frame 25. Next, by the operation of handle 37, stopper part 22 is lowered at the same time as height adjusting part 32 is rotated away from the outside of moving shelf main body 21. Next, when height adjusting part 32 is rotated toward moving shelf main body 21, engaging part 38*a* engages with outside frame 25.

Since height adjusting part 32 is made to rotate from the outside of moving shelf main body 21, this rotational operation does not interfere with the goods contained in moving shelf main body 21. Consequently, it is possible for goods to be contained in the entire interior space of moving shelf main body 21, and it is possible to ensure the carrying capacity. In addition, as shown in FIG. 1, with regard to stopper part 22 located on the route 12 side, since height adjusting part 32 is exposed to route 12 even in the state where a plurality of moving shelf main bodies 21 are contained within the scope of movement 10, since the rotational operation from the side of route 12 is simple for the operator, operability is improved. On the other hand, in cases where stopper part 22 is located on the opposite side away from route 12, since it is possible to get by with only a little operation space around the periphery of stopper part 22 that should be ensured for the rotation of height adjusting part 32, the effect given to the installation space of the moving shelf assembly is negligible.

It is possible to employ a machine which automatically operates stopper part 22 or height adjusting part 32 located on the opposite side of route 12 when stopper part 22 or height adjusting part 32 located on the route 12 side is operated. In this case, it is not necessary to ensure operating space for the rotation of height adjusting part 32 on the opposite side away from route 12.

Figure 4:
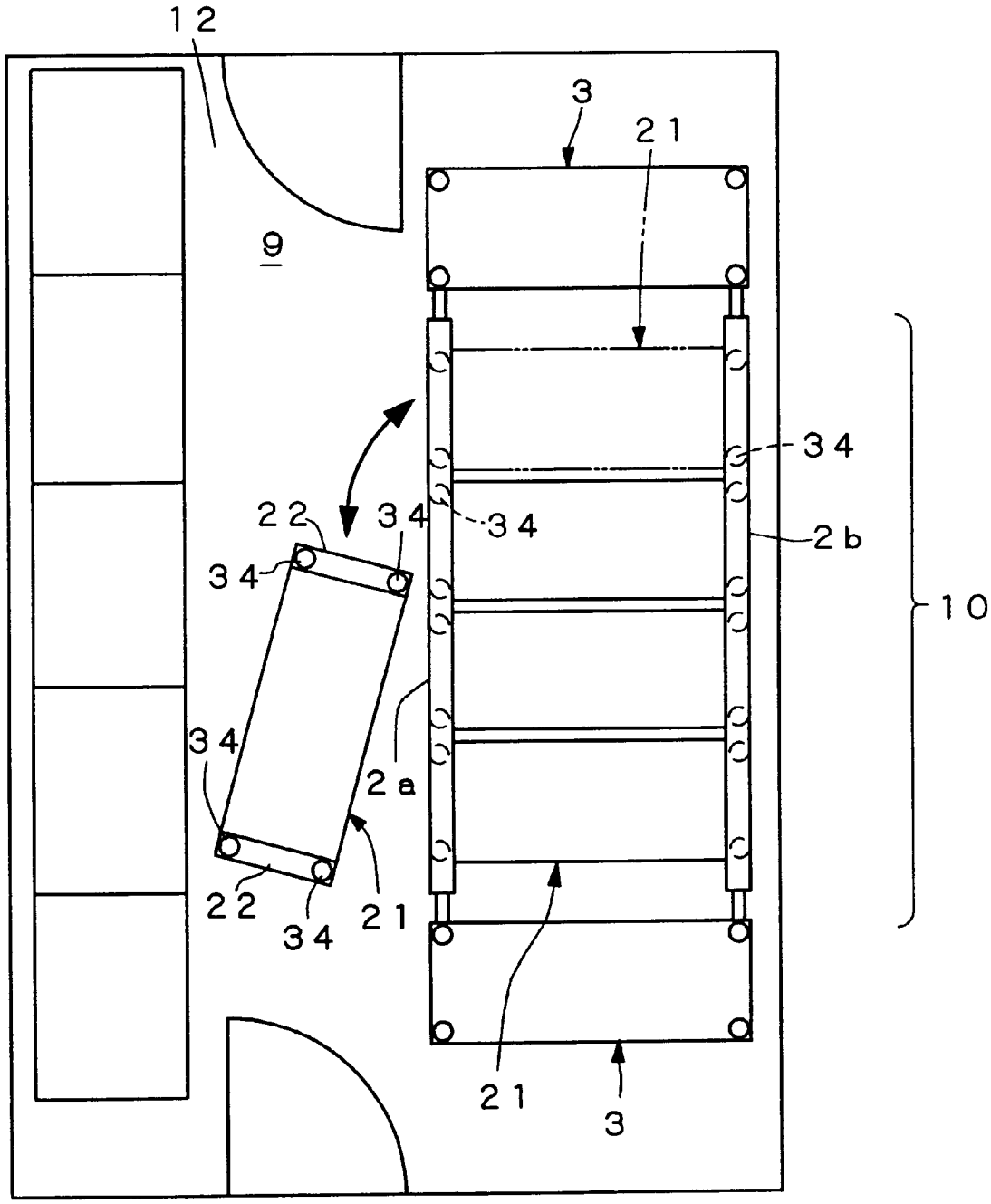
FIG. 4 is a top plan view for explaining the condition of use of the moving shelf assembly in FIG. 1.

In the state such as that shown in FIG. 3 in which plugs 34 are pulled downwards and out of guiding groove 8, since moving shelf main body 21 is not guided by rails 2*a* and 2*b*, it is possible for moving shelf main body 21 to be moved freely outside the scope of movement 10 as indicated in FIG. 4. Since moving shelf main body 21 is capable of being moved freely by means of wheels 20, it can also be used as a conveyor wagon. Consequently, it is possible to freely transport the goods between the targeted carrying location and scope of movement 10 without carrying out the operations of filling and replacing in the middle of operation, and the operability of carrying the goods is greatly improved. In addition, even in cases where a plurality of moving shelf main bodies 21 are contained within scope of movement 10 without any space between them, since it is possible to pull the targeted moving shelf main body 21 into route 12, it is not necessary to ensure space for the movement of moving shelf main body 21 within scope of movement 10. Consequently, it is possible to use all of the space within scope of movement 10 to contain goods and the amount of goods that can be stored is thus increased.

When moving the goods from outside the moving shelf assembly into a desired location within the moving shelf assembly, the goods to be contained are loaded onto moving shelf main body 21 at the loading location, and moving shelf main body 21 is transported into scope of movement 10 by moving under rails 2*a* and 2*b*. Consequently, since it is possible to house the goods in a desired location of the moving shelf assembly without having to carry out a reloading operation in the middle, the operability of storing the goods is greatly improved. In addition, when height adjusting part 32 is operated and plugs 34 of stopper part 22 are inserted into guiding grooves 8 and outside frame 25 of the highest level of shelving 24 of moving shelf main body 21 is engaged with engaging part 38*b* of height adjusting part 32, it is possible to maintain the state indicated in FIGS. 1 and 2 and make it such that moving shelf main body 21 is guided by means of rails 2*a* and 2*b*.

In this manner, in the case of the above-mentioned operation, simply by operating handle 37 of height adjusting part 32 and switching between engaging parts 38*a* and 38*b* which engage outside frame 25 of the highest level of shelving 24 (stopping part) of moving shelf main body 21, the height at which stopper part 22 is attached is simply adjusted, and the insertion and removal of plugs 34 with regard to the grooves 8 can be switched. Consequently, the operability when storing and removing moving shelf main bodies 21 is improved.

In addition, since the lower end 33 of stopper part 22 is capable of being pulled out of pole 23, it is also possible to remove stopper part 22 from moving shelf main body 21 and attach stopper part 22 when moving shelf main body 21 is brought back into scope of movement 10.

Furthermore, the present invention is not limited to the embodiments mentioned previously, for example, it is possible to make modifications such as employing moving shelf main bodies which do not use wire, or employing moving shelf main bodies equipped with self-propelled devices, or changing the structure of the height adjusting part, and it goes without saying that many types of variations can be made without deviating from the stated purpose of the invention.

What is claimed is:

1. A moving shelf assembly comprising:

moving shelf main bodies capable of moving by wheels attached to the lower portion of said main bodies and whose motion is guided by rails located above the upper portion of said main bodies;

stopper parts capable of moving up and down attached to the upper portion of each of said moving shelf main bodies, plugs capable of being inserted into and pulled out of guiding grooves open at the lower surface of said rails protruding upwards from said stopper parts; and height adjusting means connected to said stopper parts for adjusting the height at which each stopper part is attached in relation to the respective moving shelf main body so as to insert said plugs into and pull said plugs out of said guiding grooves, said height adjusting means being located under said rails such that a first part thereof is covered by said rails when said plugs are inserted into said guide grooves and a second part thereof is always exposed on the outside of said respective moving shelf main body;

wherein said moving shelf main bodies are separated from said rails when said plugs are pulled out of said guiding grooves and are then capable of being moved freely about by said wheels.

2. A moving shelf assembly according to claim 1, wherein said height adjusting part is a handle attached in a freely pivotal manner to said stopper parts and is operated by manual rotation from the outside of said moving shelf main body, engaging parts engaged to and capable of being disengaged from a stopping part formed on said moving shelf main body, said engaging parts are formed at a plurality of locations on said handle at varying intervals from the center of rotation of said handle, and wherein the height of said stopper parts is adjusted by adjusting said engaging parts engaged to said stopping part.

3. A moving shelf assembly according to claim 2, wherein each of said moving shelf main bodies are furnished with a plurality of poles extending in the vertical direction and spaced from each other, one or a plurality of shelving supported between said poles and wherein said stopping part is said shelving positioned at the upper portion of said moving shelf main body.

* * * * *